US007437992B1

(12) United States Patent
Schroeder

(10) Patent No.: US 7,437,992 B1
(45) Date of Patent: Oct. 21, 2008

(54) DIE ASSEMBLY FOR A COMPACTOR

(75) Inventor: Duane G. Schroeder, New Hope, MN (US)

(73) Assignee: Kurt Manufacuturing, Inc., Mnneapolis, MN (US)

( * ) Notice: Subject to any disclaimer, the term of this patent is extended or adjusted under 35 U.S.C. 154(b) by 0 days.

(21) Appl. No.: 11/734,584

(22) Filed: Apr. 12, 2007

Related U.S. Application Data

(60) Provisional application No. 60/791,343, filed on Apr. 12, 2006.

(51) Int. Cl.
*B30B 9/32* (2006.01)

(52) U.S. Cl. ..... 100/98 R; 100/119; 100/215; 100/226; 100/906; 100/918

(58) Field of Classification Search ..... 100/94, 100/98 R, 117, 119, 145, 146, 215, 226, 229 R, 100/906, 918
See application file for complete search history.

(56) References Cited

U.S. PATENT DOCUMENTS

| | | | | |
|---|---|---|---|---|
| 680,841 | A | 8/1901 | Chapman | |
| 2,596,872 | A | 5/1952 | Skromme | |
| 3,070,006 | A | 12/1962 | Raney et al. | |
| 3,090,182 | A | 5/1963 | Johnson | |
| 3,161,124 | A * | 12/1964 | Stromberg | 100/45 |
| 3,350,999 | A | 11/1967 | Morse | |
| 3,765,321 | A | 10/1973 | Newell | |
| 3,980,014 | A | 9/1976 | McEwen et al. | |
| 4,059,049 | A | 11/1977 | Tillgren | |
| 4,080,889 | A | 3/1978 | Shiloni | |
| 4,100,849 | A | 7/1978 | Pelton | |
| 4,162,603 | A | 7/1979 | Stromberg | |
| 4,557,190 | A | 12/1985 | Vezzani | |
| 4,594,942 | A | 6/1986 | Denneboom | |
| 4,603,909 | A | 8/1986 | LeJeune | |
| 4,897,194 | A | 1/1990 | Olson | |
| 5,173,196 | A | 12/1992 | Macrae | |
| 5,322,009 | A | 6/1994 | Retrum | |

(Continued)

FOREIGN PATENT DOCUMENTS

| | | |
|---|---|---|
| WO | WO 02/087864 | 11/2002 |

*Primary Examiner*—Jimmy T Nguyen
(74) *Attorney, Agent, or Firm*—Steven M. Koehler; Westman, Champlin & Kelly P.A.

(57) ABSTRACT

A compactor for compacting material includes a trough adapted to hold the material for compaction. A feed channel is coupled to the trough. A shearing die assembly having a first aperture aligned with the feed channel is adapted to receive material and a second aperture is adapted to receive a ramming portion. The shearing die assembly includes a first support having the first aperture, a second support facing the first support, a first plate member removably engaging the first support and having a third aperture aligned with the first aperture, a second plate member facing the first plate member and removably engaging the second support, a first intermediate plate separator removably engaging and spacing apart the first plate member and the second plate member, and a second intermediate plate separator engaging and spacing apart the first plate member and the second plate member, the second intermediate support member being disposed opposite the first intermediate plate separator, wherein surfaces of the first plate member, the second plate member, the first intermediate plate separator and the second intermediate plate separator form four sides of a compaction chamber.

2 Claims, 4 Drawing Sheets

U.S. PATENT DOCUMENTS 5,365,838 A 11/1994 Valentini
5,391,069 A 2/1995 Bendzick
5,542,348 A 8/1996 Bendzick
5,553,534 A * 9/1996 Soavi ..... 100/145
5,662,036 A 9/1997 Daniel
5,664,492 A 9/1997 Bendzick
5,694,742 A 12/1997 Elliott
5,735,197 A 4/1998 Kleine
5,832,815 A 11/1998 Bollegraaf
6,152,027 A 11/2000 Segura
6,272,981 B1 8/2001 Murata et al.
6,349,638 B1 2/2002 Thompson
2003/0024861 A1 2/2003 Schroeder et al.
2005/0109226 A1 * 5/2005 Schroeder et al. ..... 100/233

* cited by examiner

DIE ASSEMBLY FOR A COMPACTOR

CROSS-REFERENCE TO RELATED APPLICATION

The present application is based on and claims the benefit of U.S. provisional patent application Ser. No. 60/791,343, filed Apr. 12, 2006, the content of which is hereby incorporated by reference in its entirety.

BACKGROUND

In some manufacturing processes, metals and other materials can be manipulated through various machining processes. During these processes, liquids are often applied to serve as lubricants and coolants. Depending on the material composition and the specific manufacturing needs, the liquid can be quite costly. The processes inevitably results in waste consisting of material and liquid. Any material or liquid that can be saved and reused, or properly disposed of, can provide significant savings.

Costs associated with the disposal or recycling of the material waste are increased if liquid remains. Liquid used during a specific process may leave a material unusable until that liquid has been nearly completely separated from the material. Further, an efficient and thorough separation of the manufacturing material and the liquid can assure that material and liquid reuse is maximized. This in turn makes it more likely that reusable material or liquid is not being disposed of with the unusable or unwanted waste.

Further, various governmental laws and regulations require proper disposal and removal of many defined materials and liquids. If these laws and regulations are not specifically followed, costly fines and other penalties may be imposed. An efficient separation and compaction process facilitates conformity with these requirements.

Conventional material compacting devices are so-called briqueting machines that carry out numerous steps to create a block of compacted material. The machines compact relatively comminuted shavings and scrap. The key to these machines is the repetitive hydraulic or mechanical steps that are performed on each block of material against a resistive gate.

These briqueting machines focus the compaction process on this repetitive gate system. Material waste is fed into a compaction chamber. This compaction chamber generally consists of a ramming device and a gate, at opposing ends. The material waste is fed into the chamber so that it rests in between the ramming device and the gate. One or more compaction stages are performed on the material. Generally, an initial compaction stage advances the ramming device under low pressure, loosely compacting the material under pressure against the gate. This ramming device will be driven by either hydraulic or mechanical means. The hydraulic or mechanical means can function in the same manner as a mechanical device (i.e., punch press), or other like devices, for repeatedly advancing the ramming device forward, thus pressing the material against the gate.

Following initial compression, a second compaction stage generally occurs where the loosely compacted waste is subject to high pressure from the ramming device against the gate. Desired compression levels and ramming steps and/or energy are directly related, and as such, a highly compacted mass of material requires significant ramming steps and/or exerted energy on the material. After compaction is complete the machine must engage in several motions or steps just to eject the material block and to set up for the next grouping of material. The ramming device must retract and the gate must be raised or relocated from its end position in the compaction chamber in order to allow for the ejection of the material. The ramming device is then operated at low pressure in a forward direction to discharge the compacted material waste from the compaction chamber. Upon discharge of the block, the ramming device and the gate must move back to their original positions in the compaction chamber. This repetitive process must be performed for each individual grouping of material loaded into the compaction chamber.

There is an innate inefficiency embodied within the processes utilized by these conventional compaction machines. Wasted motion and energy is inevitable within any of these systems that rely on a gate system. A continuous compaction process is impossible to achieve. The wasted movement of the ramming device within a gate system means that such a device will unnecessarily increase manufacturing time and energy costs. Any attempt to reduce the processes or ramming steps with these conventional machines will inevitably result in a reduction in the level of compaction and liquid separation.

Even when conventionally acceptable ramming steps and exerted energy levels are utilized, material compaction and liquid separation are not optimal. While the current machines do measurably compact and remove liquid from the surfaces and interior of the material waste, there is room for sizeable improvement. Consequently, a more efficient and effective machine is needed to minimize costs and to maximize material compaction and liquid separation.

The discussion above is merely provided for general background information and is not intended to be used as an aid in determining the scope of the claimed subject matter.

SUMMARY

A compactor for compacting material includes a trough adapted to hold the material for compaction. A feed channel is coupled to the trough. A shearing die assembly having a first aperture aligned with the feed channel is adapted to receive material and a second aperture is adapted to receive a remaining portion. The shearing die assembly includes a first support having the first aperture, a second support facing the first support, a first plate member removably engaging the first support and having a third aperture aligned with the first aperture, a second plate member facing the first plate member and removably engaging the second support, a first intermediate plate separator removably engaging and spacing apart the first plate member and the second plate member, and a second intermediate plate separator engaging and spacing apart the first plate member and the second plate member, the second intermediate support member being disposed opposite the first intermediate plate separator, wherein surfaces of the first plate member, the second plate member, the first intermediate plate separator and the second intermediate plate separator form four sides of a compaction chamber.

This Summary is provided to introduce some concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Figure 1:
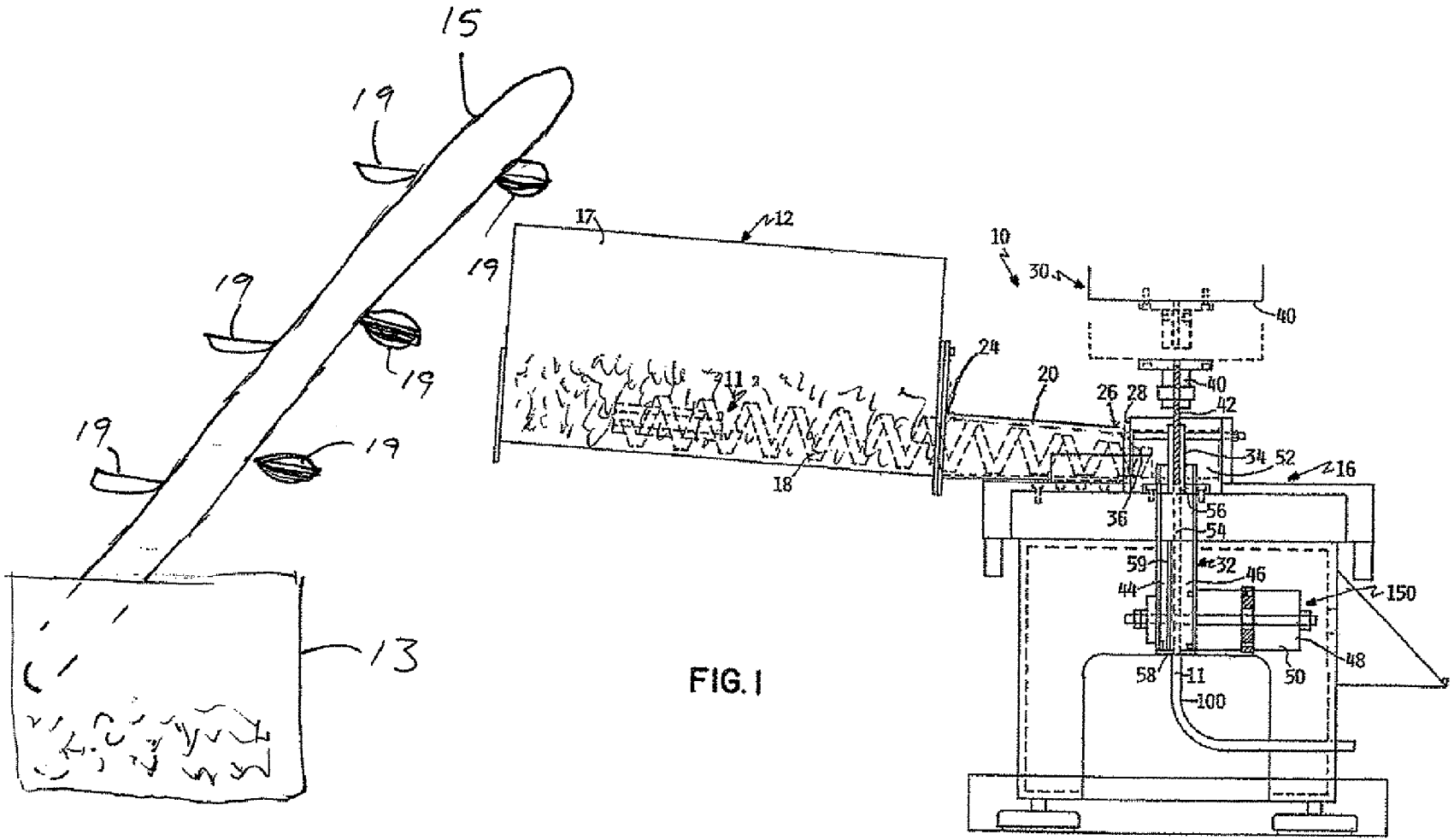
FIG. 1 is a side view of a material compactor.

Referring to the figures, an exemplary embodiment of a material compactor 10 is illustrated. This material compactor 10 generally comprises an initial feed apparatus 12 and a compaction apparatus 16. If desired, a container 13 and conveyer system 15 (shown schematically) can be utilized to transport material on or around ground level from container 13 to feed apparatus 12 through conveyer system 15. Container 13 can be included such that material positioned therein moves to one ends. Conveyor system 15 includes a plurality of scoops 19 to retrieve material from container 13 and deposit the material in feed apparatus 12. In relevant figures, certain dashed lines are included to demonstrate the potential movement (i.e., the start and finishing positions) for corresponding movable components (i.e., rams, plates, and the like), and to show hidden structures. Various embodiments of the material compactor 10 include, in part at least, structure, functions, and devices described and disclosed previously by the present Applicant in U.S. Pat. No. 7,011,018 and as a result said patent is incorporated herein by reference in its entirety.

Referring primarily to FIG. 1, the feed apparatus 12 generally comprises a bin or through 17, at least one auger 18, and a feed channel or auger tube 20. The feed channel 20 is in communication with the bin 17 and generally receives at least a portion of the auger 18. The feed channel 20 can include an entry portion 24, an exit portion 26, and a feed apparatus coupling 28.

Although herein illustrated wherein auger 18 is positioned throughout a substantial portion of feed channel 20, the auger 18 can terminate at any position, as desired. For example, auger 18 can terminate at entry portion 24, at exit portion 26 or at other positions. The feed channel 20 provides a channel for communication of material 11 from the bin 17 into the compaction apparatus 16. In particular, the entry portion 24 receives the material driven through the bin 17 by the auger 18. The exit portion 26 can be smaller in cross-sections than the entry portion 24, if desired, such that tapering will provide an additional degree of initial compaction as the material is forcibly passed through the feed channel 20 into the compaction apparatus 16. The feed coupling 28 provides an attachment point for joining the feed apparatus 12 to the compaction apparatus 16. The auger 18 can be rotationally driven from at least one end by a motor and transmission, in forward and reverse.

Figure 3:
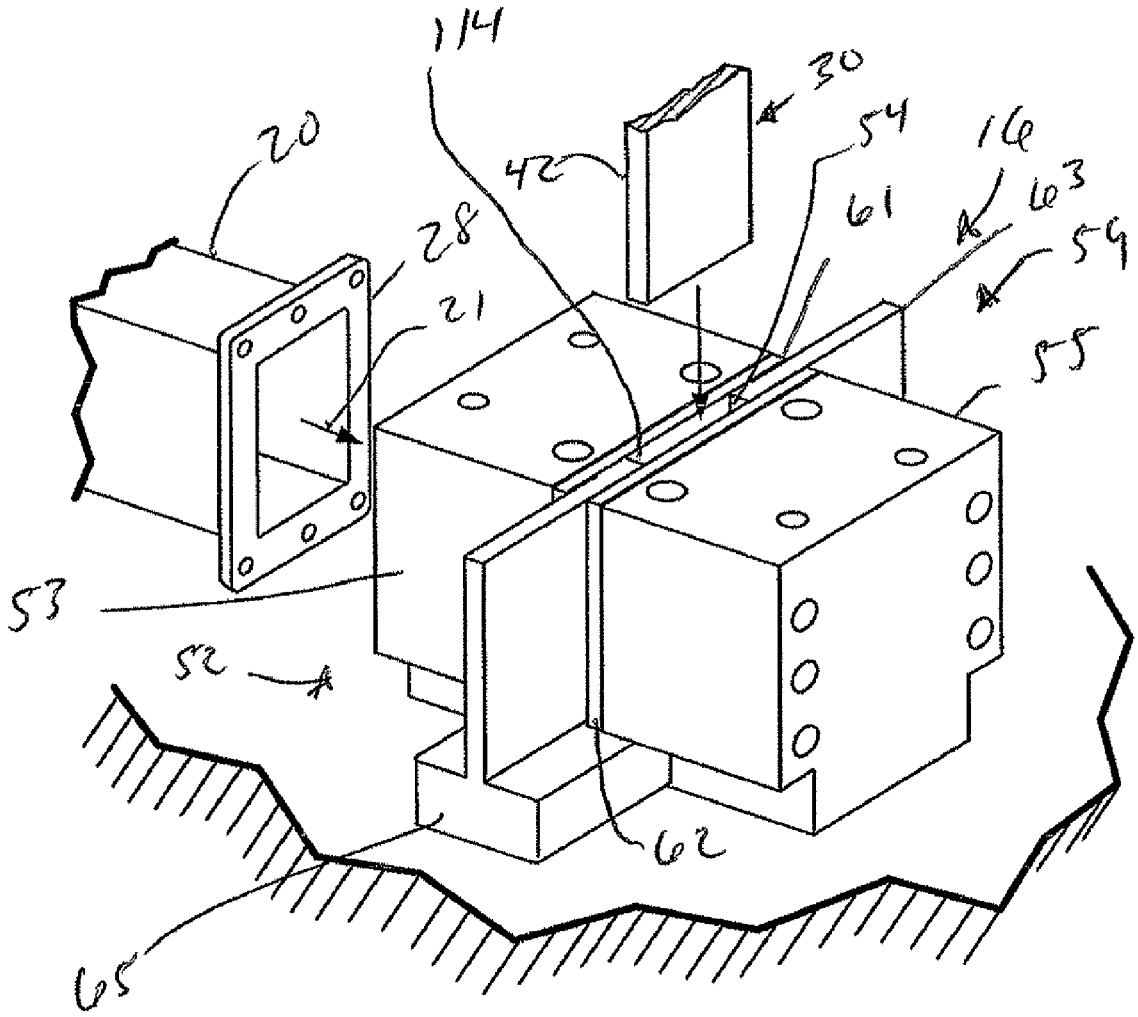
FIG. 3 is a perspective view of a die assembly.

The auger 18 extends from the bin 17 into the feed channel 20. Referring to FIG. 3, the feed channel 20 is non-circular in cross-section. It has been discovered a feed channel 20 that is a non-circular in cross-section more effectively moves material from the bin 17 to the compaction apparatus 16. With circular feed channels, some material tends to rotate with the auger 16 without moving, or moving slowly, longitudinally along the feed channel. The feed channel 20 with a non-circular cross-section inhibits mere rotation of the material with the auger 18, thereby causing it to move longitudinally along the feed channel 20. In one embodiment, the feed channel 20 is generally rectangular or square having slightly rounded corners. The inside dimensions between opposing walls of the feed channel 20 can be of lengths slightly larger than that of the diameter of the auger 18.

As appreciated by those skilled in the art, other non-circular configurations of the feed channel 20 in cross-section can be used such as but not limited to a rectangular shape, a triangular shape, a pentagonal shape, a hexagonal shape, etc. Stated another way, the inner walls of the feed channel 20 can be formed so as to substantially inhibit the material from rotating with the auger 18 in a generally stationary position along the length of the feed channel 20. Accordingly, portions of the inner wall varies in distance from the center of the feed channel 20 (indicated by arrow 21) along the perimeter thereof in cross-section. Alternatively, or in addition, protrusions (fins, ribs, etc.) can be attached to or formed on the inner wall to aid or accomplish the purpose of substantially inhibiting the material from rotating with the auger 18 in a generally stationary position along the length of the feed channel 20.

In one embodiment, the feed coupling 28 has a similar cross-section to that of the feed channel 20. Further, the feed coupling 28 can be implemented and connected in a modular fashion with other couplings to permit variable connectability to promote flexibility in positional configurations for the feed apparatus 12 relative to the final compaction apparatus 12.

Figure 2:
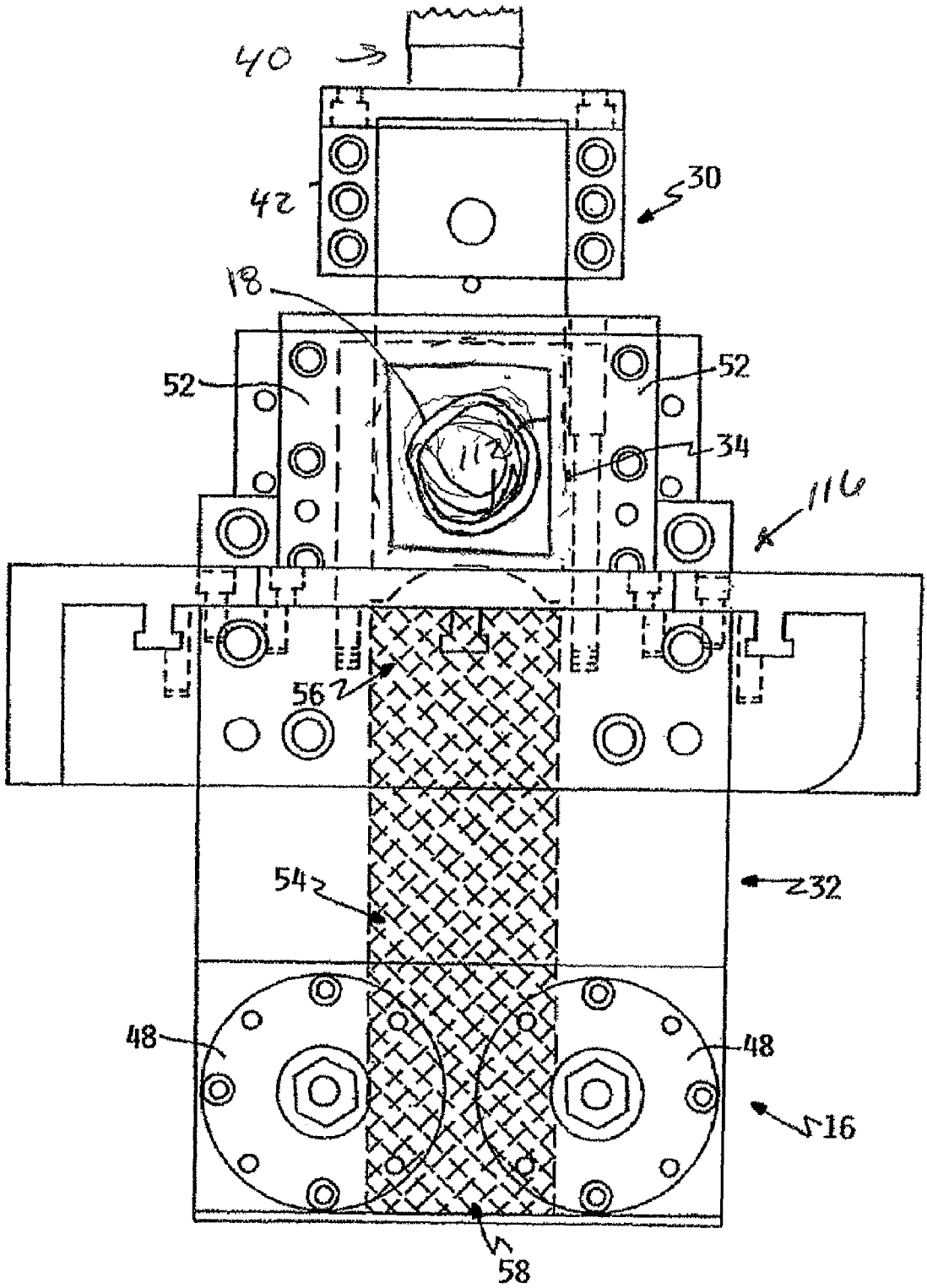
FIG. 2 is a side view of the material compactor of FIG. 1.

One embodiment of the compactor 10 and the final compaction apparatus 16 is shown in FIGS. 1-2. The compaction apparatus 16 generally comprises a ramming device 30, and a shearing die assembly 52. The ramming device 30 is oriented for axial movement along an inner chamber cavity 54 of a further compaction chamber 32, in a horizontal or vertical direction. This ramming device 30 comprises a driving device 40 (schematically represented) known in the art for advancing a ramming portion 42 into the compaction chamber 32 and the inner chamber cavity 54. Those skilled in the art will understand the driving device 40 to include hydraulic, pneumatic, mechanically driven technology, and the like. For one mechanical embodiment, the driving device 40 (schematically represented) can comprise mechanically or hydraulically driven technology such as a punch press. Depending on the desired speed, manufacturing and energy costs, and efficiency goals, various rated/tonnage machines and shaped machines (L, H, etc.) can be utilized.

A continuous communication path is created by the connecting of the feed apparatus 12 to the final compaction apparatus 16. Referring to FIGS. 1-2, the feed channel 20 is coupled to the final compaction apparatus 16 by securing the feed apparatus coupling 28 to a shearing die assembly 52 having feed channel 34. As such, fluid communication continues from the feed channel 20 to the axially aligned feed channel 34 and into the inner cavity 54 of the chamber 32.

The feed channel 34 can generally comprise a shearing die 52, described in detail below, having a material entry aperture 112 defined therein, and a ram passage aperture 114 defined therein. The shearing die 52 is couplable to elements forming the compaction chamber 32. The aperture 112 and aperture 114 are generally in transverse communication. Further, a plurality of mounting apertures 116 and corresponding fasteners comprise the system for coupling the die 52 to the elements of the compaction chamber 32, as shown in FIG. 2. The feed channel 34 and the material entry aperture 112, are generally aligned with the inner cavity 54. The ramming portion 42 of the ramming device 30 is disposed and aligned for axial movement along, and in and out of, the inner cavity 54 to provide the ramming force to forcibly move and compact the material 11 through the compaction chamber 32, from the entry portion 56 to the discharge port 58. If desired, the compaction chamber 32 can further include internal plating systems to provide a level of "give" within the confines of the chamber, and/or the entry aperture 112, when material 11 is moved into, and compacted within. Namely, adjustable plates, spring-loaded plates, defined voids, and like techniques known to one skilled in the art enables adjustment, including dynamic adjustment, of the internal area of the compaction chamber 32 upon filling with pre-compacted material 11.

The compaction chamber 32, discharge trough and control system are not pertinent to aspects of the invention described herein; however, embodiments are described in detail in U.S. Pat. No. 7,011,018.

Generally, material 11 is initially channeled into the feed channel 20 of the feed apparatus 12 by the auger 18. The material 11 can be channeled by the auger 18 directly from and through the bin 17 and into the feed channel 20. As material 11 is directed into the entry portion 24, through the feed channel 20, and through to the material exit portion 26, the once loosely grouped chips from the bin 17 are subjected to initial compaction from the forced movement of the chips through the limited space of the channel 20. The feed channel 20 and auger 18 described above can be used; however, for other aspects of the present invention different devices such as but not limited to use of a chain system wherein a chain (i.e., a bam chain) with connected paddles, and/or other devices, can be used to carry and transport the material to the bin 17.

Figure 4:
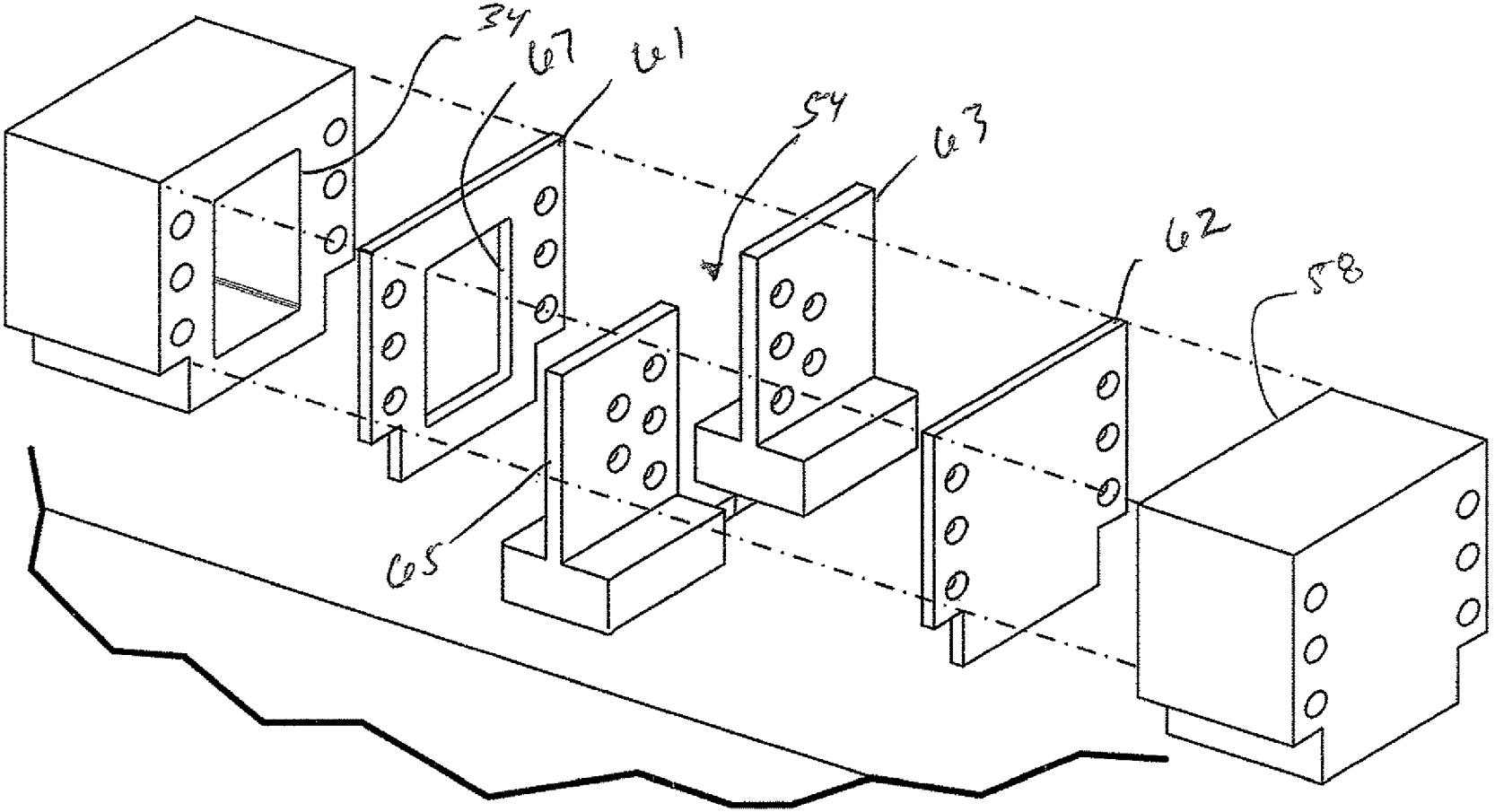
FIG. 4 is an expanded view of the die assembly of FIG. 3

Feed channel 20 is coupled to a shearing die assembly 52 that positions the material 11 in a chamber 54 formed by walls of the shearing die assembly 52 for compaction by the ramming portion 42. The action of the ramming causes wear upon the faces of the shearing die assembly 52. An aspect of the present invention further includes the shearing die assembly 52 and the construction thereof from easily made components that also allow quick disassembly and reassembly. As illustrated in FIGS. 3 and 4, the shearing die assembly 52 includes die supports 53 and 55. Die support 53 is generally a block (e.g. formed of orthogonal faces) that includes feed channel 34 that receives material 11. The feed channel 34 can have similar shape to that of the cross-section of the feed channel 20 in order to allow easy flow of the material 11 and maintain any compaction produced in the feed channel 20. Die support 55 is generally a block (e.g. formed of orthogonal faces) of material having a flat surface 58 facing die support 53.

Chamber forming components 59 for forming chamber 54 are disposed between die supports 53 and 55. The chamber forming components 59 forms four sides of chamber 54 (having an open top and open bottom) that receives both the material 11 from feed channel 34 and ramming portion 42 from above. In the embodiment illustrated, chamber forming components 59 include plate members 61 and 62 that are held against die supports 53 and 55, respectively, and intermediate plate separators 63 and 65. Both plate members 61 and 62 are of a simple design (e.g. formed of flat orthogonal sides) from a block of material such as steel. Plate member 61 includes an aperture 67 similar in shape to feed channel 34, while plate member 62 has flat surfaces. Plate separators 63 and 65 are also generally formed as blocks from a material such as steel.

Die supports 53, 55, plate members 61, 63 and plate separators 63, 65 each include apertures and/or threaded apertures so as to allow a plurality of fastening bolts to extend therethrough from die support 53 to die support 55. In this manner, shear die assembly 52 can be easily disassembled to remove and replace plate members 61, 62 as necessary and plate separators 63, 65 as necessary typically to less often. The simple design of plate members 61, 62 and plate separators 63, 65 as block members allows them to be formed easily and at low cost. It should also be noted plate member 62 could be merely reversed since each side can be formed as a flat surface thereby extending the life of this component. Likewise, the ramming device 42 can be reversed.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A compactor for compacting material, comprising:

a trough adapted to hold the material for compaction;

a feed channel coupled to the trough;

a shearing die assembly having a first aperture aligned with the feed channel and adapted to receive material and a second aperture adapted to receive a ramming portion, the shearing die assembly comprising:

a first support having the first aperture;

a second support facing the first support;

a first plate member removably engaging the first support and having a third aperture aligned with the first aperture;

a second plate member facing the first plate member and removably engaging the second support;

a first intermediate plate separator removably engaging and spacing apart the first plate member and the second plate member;

a second intermediate plate separator engaging and spacing apart the first plate member and the second plate member, the second intermediate plate separator being disposed opposite the first intermediate plate separator, wherein surfaces of the first plate member, the second plate member, the first intermediate plate separator and the second intermediate plate separator form four sides of a compaction chamber.

2. The apparatus of claim 1 wherein the feed channel includes an inner, non circular wall.

* * * * *